US005988091A

United States Patent [19]

Willis

[11] Patent Number: 5,988,091

[45] Date of Patent: Nov. 23, 1999

[54] JET SKI BRAKE APPARATUS

[76] Inventor: Charles M. Willis, 12240 Eakin St., Brooksville, Fla. 34614

[21] Appl. No.: 09/197,883

[22] Filed: Nov. 23, 1998

[51] Int. Cl.[6] ..... B63H 25/34

[52] U.S. Cl. ..... 114/145 R; 114/285

[58] Field of Search ..... 114/145 R, 145 A, 114/285

[56] References Cited

U.S. PATENT DOCUMENTS

| | | | |
|---|---|---|---|
| 2,994,290 | 8/1961 | Merchant . | |
| 3,209,716 | 10/1965 | Hartley . | |
| 5,193,478 | 3/1993 | Mardikian | 114/285 |
| 5,377,610 | 1/1995 | Goebel | 114/145 R |
| 5,493,990 | 2/1996 | Dyer | 114/145 A |

FOREIGN PATENT DOCUMENTS

| | | | |
|---|---|---|---|
| 2172866 | 10/1986 | United Kingdom | 114/285 |

*Primary Examiner*—Jesus D. Sotelo

[57] ABSTRACT

A brake apparatus is provided for a water craft that has a rear discharge nozzle and includes a first craft attachment member attached to a portion of the water craft. A hinge assembly is connected to the first craft attachment member. A brake plate assembly is connected to the hinge assembly. A brake plate control assembly is connected to the brake plate assembly. The brake plate control assembly includes a control cable connected to the brake plate assembly. The water craft is a jet ski. When the brake plate member is impinged by water flow from the discharge nozzle of the jet ski, the water flows upward, causing a reactive downward force which pushes the stem of the jet ski into the water, whereby a drag and braking action is created. A rudder member may also be attached to the discharge nozzle to assist in steering the jet ski.

14 Claims, 4 Drawing Sheets

FIG 1
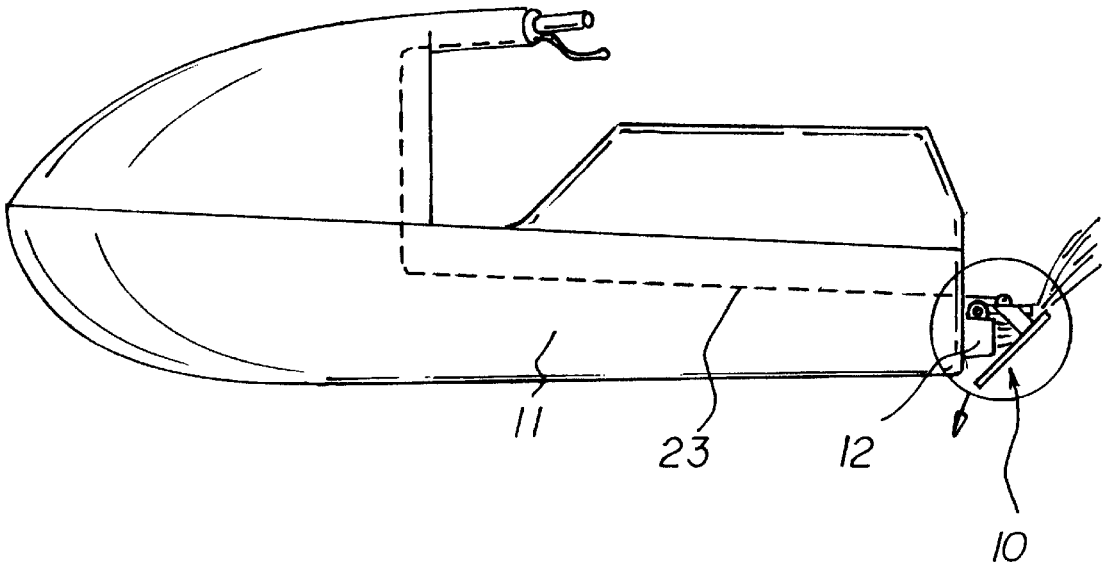
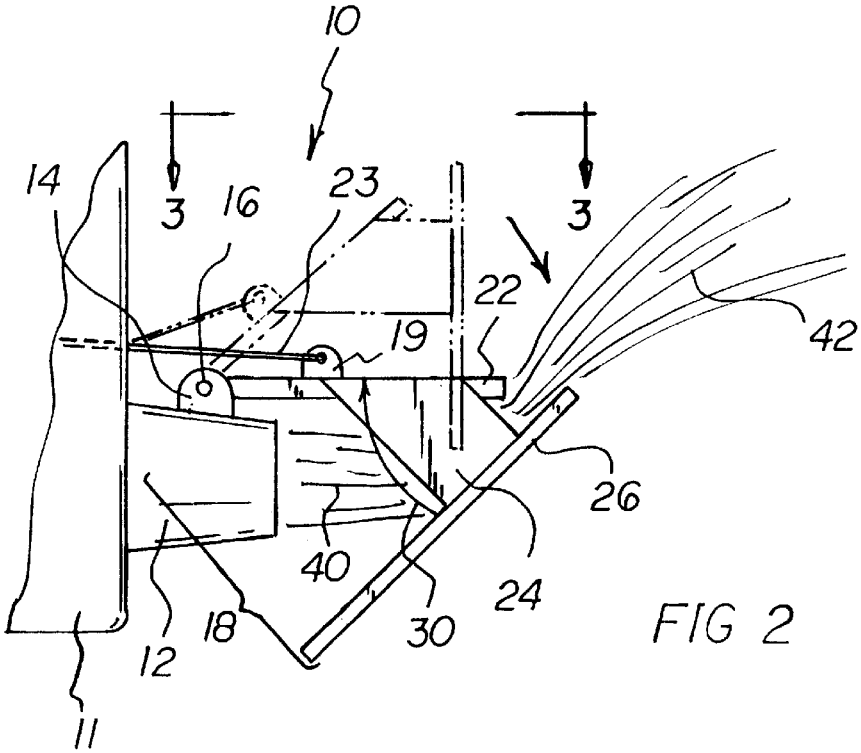
FIG 2

FIG 3
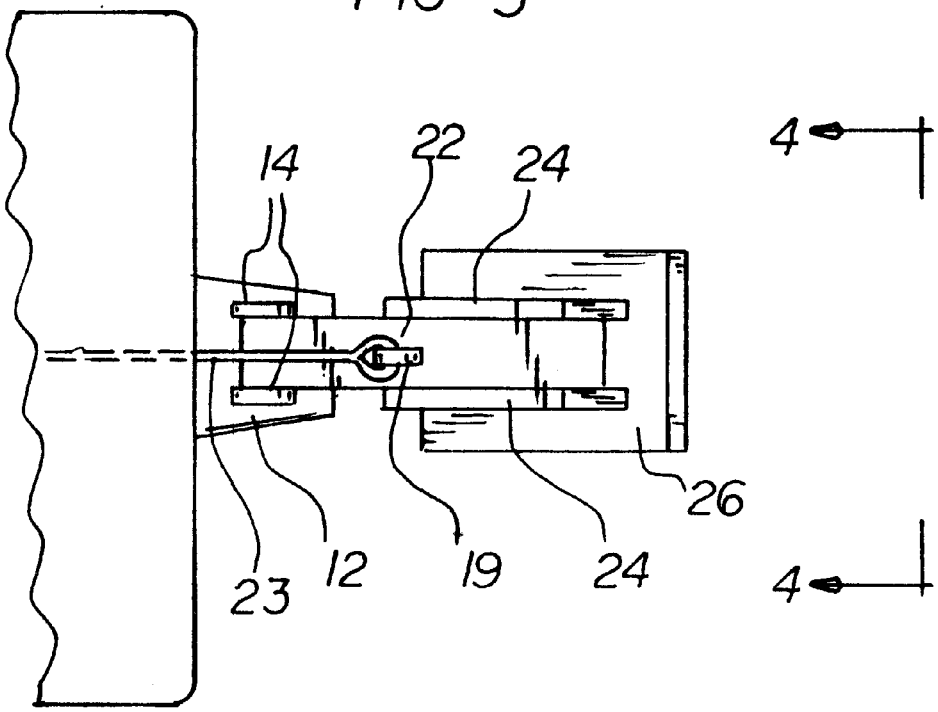
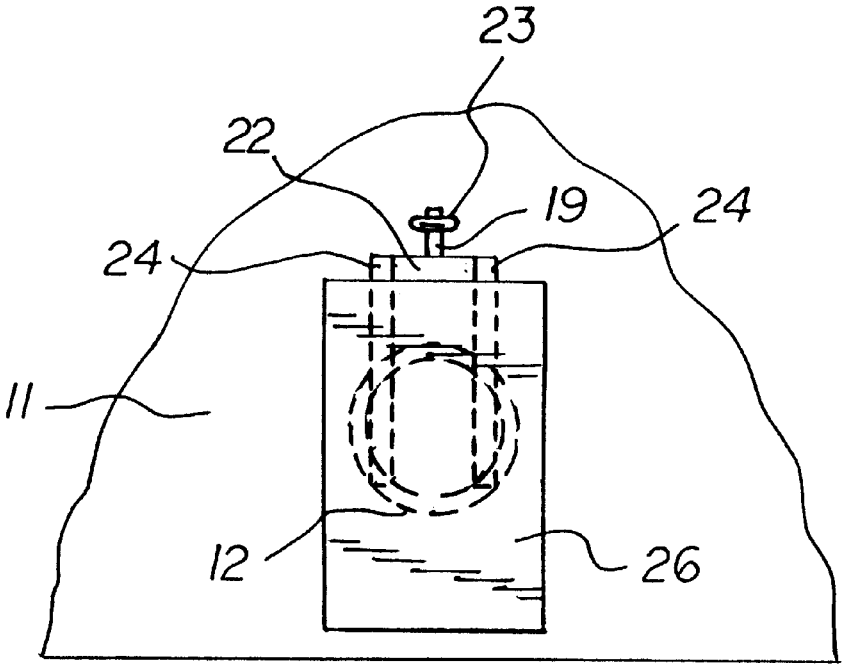
FIG 4

FIG 5
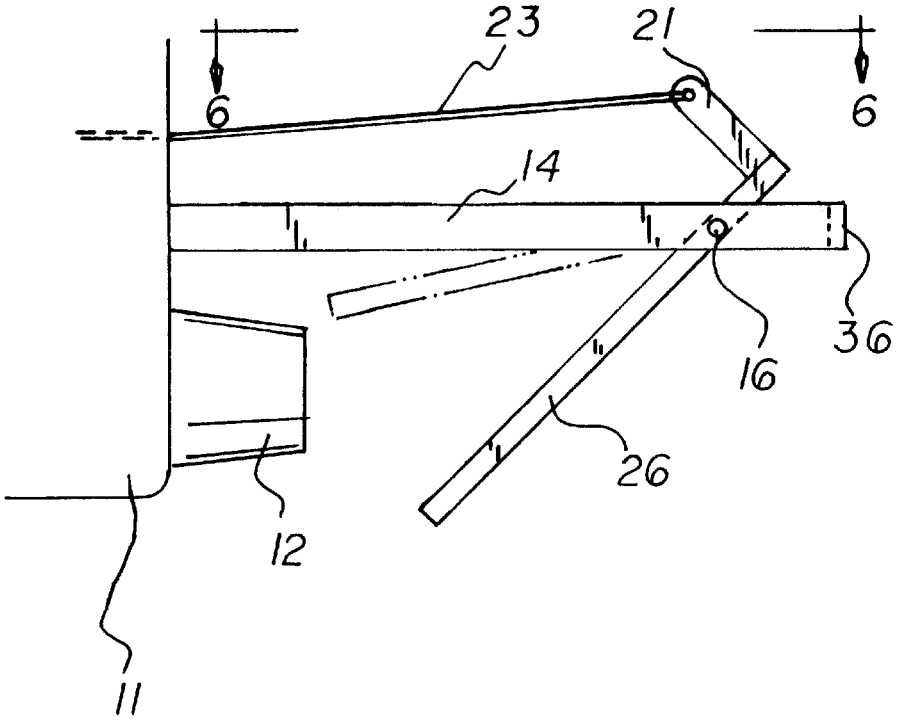
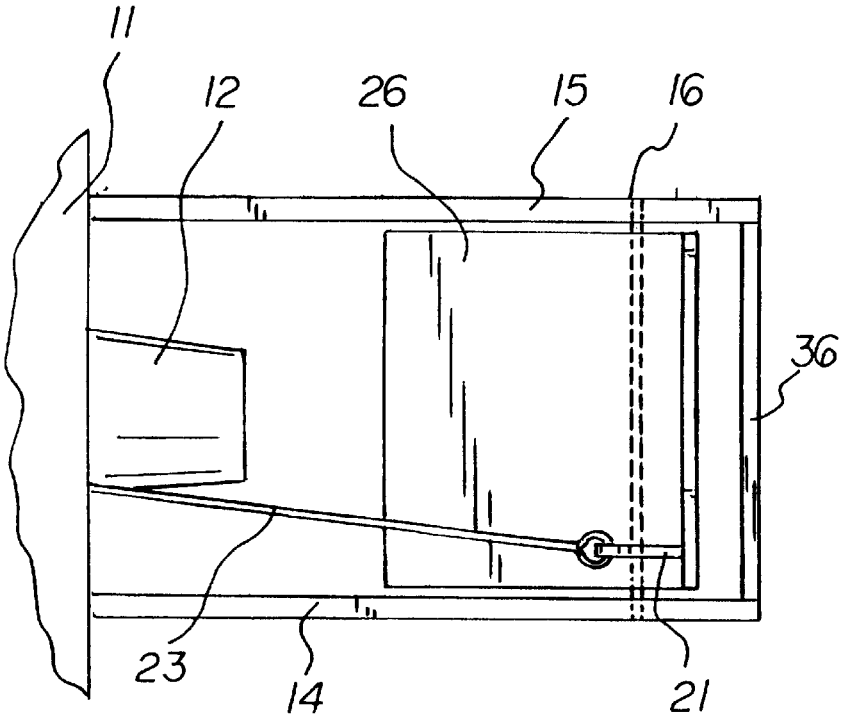
FIG 6

FIG 7
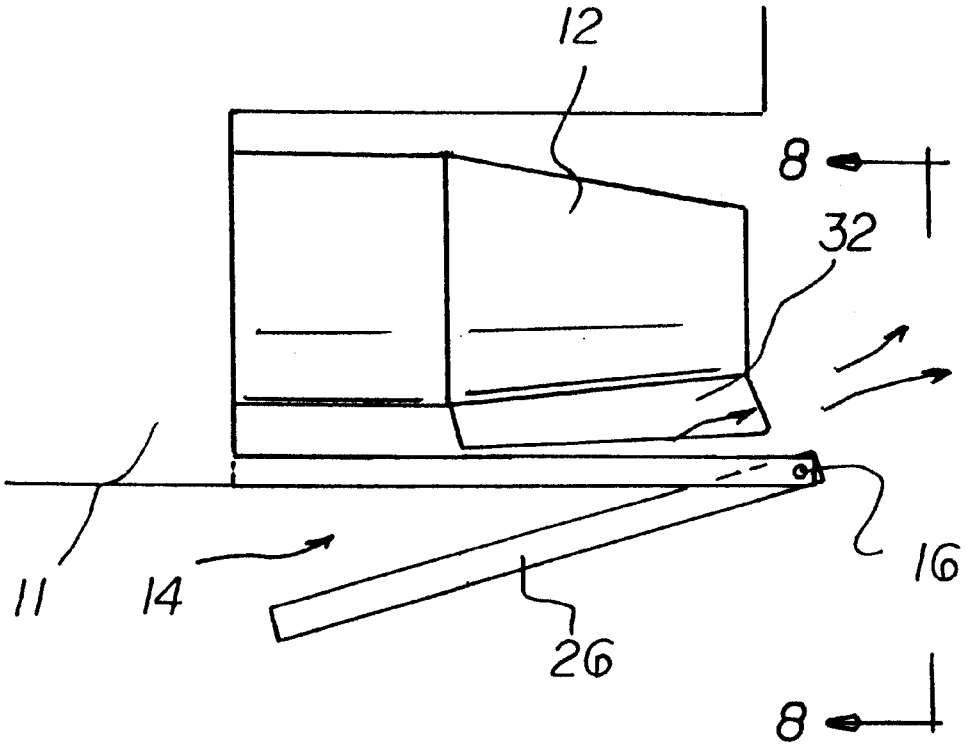
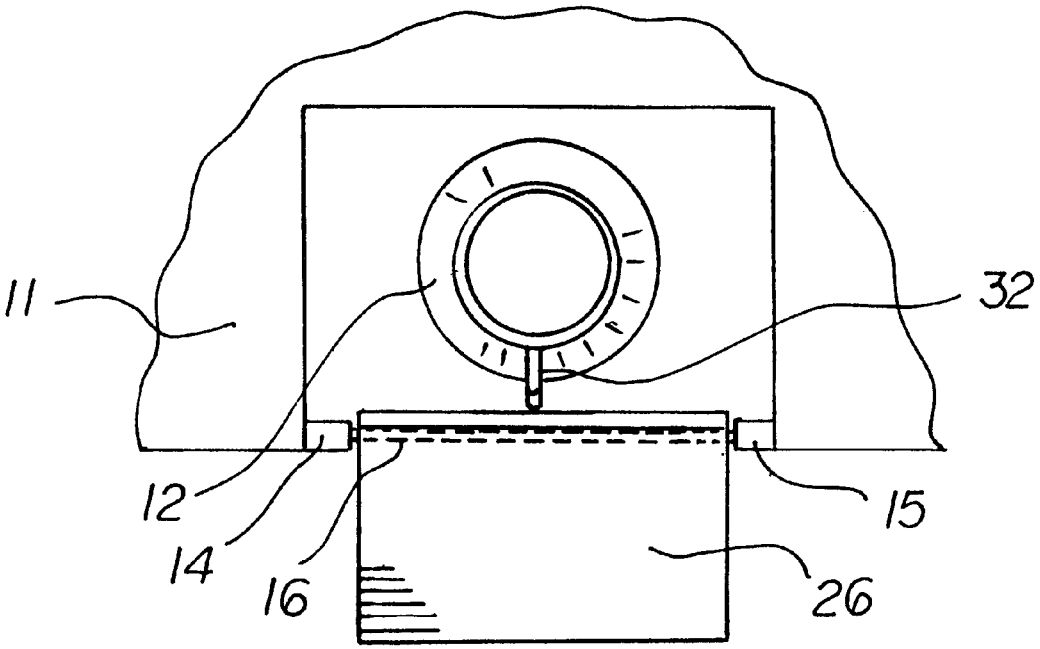
FIG 8

JET SKI BRAKE APPARATUS

BACKGROUND OF THE INVENTION

1. Field of the Invention

The present invention relates generally to water craft and, more particularly, to devices especially adapted for braking water craft.

2. Description of the Prior Art

A type of water craft that is very popular is known as a jet ski. With a jet ski, a stream of water emerges from a nozzle at the rear of the jet ski, and the stream of water provides thrust for the jet ski. As with all water craft, slowing down and stopping a water craft may be difficult to do, especially if the water craft is moving through the water at a relatively high speed. In this respect, throughout the years, a number of innovations have been developed relating to slowing down and stopping water craft, and the following U.S. patents are representative of some of those innovations: U.S. Pat. Nos. 2,994,290, 3,209,716, 5,193,478, 5,377,610, and 5,493,990.

More specifically, U.S. Pat. No. 2,994,290 discloses a retractable drag device for boats which includes a pair of drag plates that are selectively movable from non-drag to drag orientations. In the drag orientation, the drag plates block and reflect the horizontal flow of water impacted by the drag plates as the boat moves through the water. As a result, the drag plates do not provide a force component that forces the stern of the boat deeper into the water. Forcing the stern of the boat deeper into the water would serve to add additional drag from the stem of the boat, to augment the drag offered by the drag plates. In this respect, it would be desirable if a brake for a water craft were provided which increases drag by forcing the stem of the water craft deeper into the water.

U.S. Pat. No. 3,209,716 discloses a speed reduction device that is placed adjacent to a propeller of an outboard motor of a water craft. The device is attached to a fin of the propeller support. This device operates automatically at certain low speeds and is not under the control of the water craft operator. Operator control is important. Therefore, it would be desirable if a brake apparatus for a water craft were provided that is under the control of the operator of the water craft.

U.S. Pat. No. 5,193,478 discloses an adjustable brake and control flaps for water craft which employs a special water craft having a hull that has a housing area for accommodating the adjustable brake and the control flaps. Instead of requiring a water craft that has a hull with a special brake housing area, it would be desirable if a brake apparatus for a water craft were provided that easily fits onto a water craft having a conventional hull for easy retrofitting of the water craft with the brake apparatus.

U.S. Pat. No. 5,377,610 discloses a sailboat brake apparatus that employs a plurality of drag plates that rotate around a vertical axis and provide horizontally oriented drag for the sailboat when the drag plates are rotated to be facing into the direction of motion of the sailboat in the water. As discussed above with respect to U.S. Pat. No. 2,994,290, such drag plates do not provide a force component that forces the stern of the boat deeper into the water to provide added drag from the stern of the boat.

U.S. Pat. No. 5,493,990 discloses a trolling plate that is attached to an outboard motor of a boat to cover the propeller when the trolling plate is in operation. The trolling plate is on a horizontal hinge that is located above the propeller. As a result, when the trolling plate is in operation, water is directed downward by the trolling plate. The downward directing of the water causes a reactive force to be exerted upward on the stern of the boat, causing the stern of the boat be receive a lifting force as the trolling plate is in operation. As stated above, to maximize braking operation, it would be desirable if a braking device for a water craft caused the stern to be forced downward into the water to make use of increased drag caused by the stern of the water craft.

Still other features would be desirable in a brake apparatus for a water craft. More specifically, in consideration of the popularity of jet skis, it would be desirable if a brake apparatus were provided that is especially adapted for braking jet skis. Aside from braking a jet ski, it would be desirable if a brake apparatus also had features for assisting in the steering of the jet ski as the jet ski is being braked.

Thus, while the foregoing body of prior art indicates it to be well known to use brakes for water craft, the prior art described above does not teach or suggest a brake apparatus for water craft which has the following combination of desirable features: (1) increases drag by forcing the stern of the water craft deeper into the water; (2) is under the control of the operator of the water craft; (3) easily fits onto a water craft having a conventional hull for easy retrofitting of the water craft with the brake apparatus; (4) is especially adapted for braking jet skis; and (5) assists in the steering of the jet ski as the jet ski is being braked. The foregoing desired characteristics are provided by the unique jet ski brake apparatus of the present invention as will be made apparent from the following description thereof Other advantages of the present invention over the prior art also will be rendered evident.

SUMMARY OF THE INVENTION

To achieve the foregoing and other advantages, the present invention, briefly described, provides a brake apparatus for a water craft that has a rear discharge nozzle. The brake apparatus includes a first craft attachment member attached to a portion of the water craft. A hinge assembly is connected to the first craft attachment member. A brake plate assembly is connected to the hinge assembly. A brake plate control assembly is connected to the brake plate assembly. The brake plate control assembly includes a control cable connected to the brake plate assembly. The water craft is a jet ski.

With one embodiment of the invention, the first craft attachment member is attached to the discharge nozzle of the jet ski. The brake plate assembly includes a control arm which is connected to the hinge assembly. A control cable connection bracket is connected to the control arm, and plate support struts are connected to the control arm. A brake plate member is connected to the plate support struts. The brake plate member is oriented at a fixed acute orientation angle with respect to the control arm.

With another embodiment of the invention, the first craft attachment member is attached to a stern portion of the jet ski. A second craft attachment member attached to a stern portion of the jet ski parallel to the first craft attachment member. The first craft attachment member and the second craft attachment member are connected to the stern portion of the jet ski at positions above the discharge nozzle. A reinforcement strut is connected between the first craft attachment member and the second craft attachment member. The hinge assembly extends between the first craft attachment member and the second craft attachment member. The brake plate assembly is connected directly to the hinge assembly. The brake plate assembly includes a brake plate member connected to the hinge assembly and includes a control cable connection bracket attached to an end portion of the brake plate member. The brake plate assembly is positioned distal to the discharge nozzle of the jet ski.

With another embodiment of the invention, the craft attachment member is connected to a stern portion of the jet ski at a position below the discharge nozzle. The brake plate assembly is positioned under the discharge nozzle of the jet ski. A rudder member is connected to a bottom portion of the discharge nozzle and extends downward towards the brake plate assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jet ski brake apparatus which has all of the advantages of the prior art and none of the disadvantages.

It is another object of the present invention to provide a new and improved jet ski brake apparatus which may be easily and efficiently manufactured and marketed.

It is a further object of the present invention to provide a new and improved jet ski brake apparatus which is of durable and reliable construction.

An even further object of the present invention is to provide a new and improved jet ski brake apparatus which is susceptible of a low cost of manufacture with regard to both materials and labor, and which accordingly is then susceptible of low prices of sale to the consuming public, thereby making such jet ski brake apparatus available to the buying public.

Still yet a further object of the present invention is to provide a new and improved jet ski brake apparatus which increases drag by forcing the stern of the water craft deeper into the water.

Still another object of the present invention is to provide a new and improved jet ski brake apparatus that is under the control of the operator of the water craft.

Yet another object of the present invention is to provide a new and improved jet ski brake apparatus which easily fits onto a water craft having a conventional hull for easy retrofitting of the water craft with the brake apparatus.

Even another object of the present invention is to provide a new and improved jet ski brake apparatus that is especially adapted for braking jet skis.

Still a further object of the present invention is to provide a new and improved jet ski brake apparatus which assists in the steering of the jet ski as the jet ski is being braked.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a first embodiment of the jet ski brake apparatus of the invention attached to a nozzle of a jet ski.

FIG. 2 is an enlarged side view of the portion of the embodiment of the jet ski brake apparatus shown in FIG. 1 enclosed in the circled region 2 thereof.

FIG. 3 is a top view of the portion of the embodiment of the invention shown in FIG. 2 taken along line 3—3 thereof.

FIG. 4 is a rear view of the embodiment of the invention shown in FIG. 3 taken along line 4—4 thereof.

FIG. 5 is a side view of a second embodiment of the invention attached to the stem of a jet ski.

FIG. 6 is a top view of the embodiment of the invention shown in FIG. 5 taken along line 6—6 thereof.

FIG. 7 is a side view of a third embodiment of the invention which includes a rudder attached to a nozzle of a jet ski.

FIG. 8 is a rear view of the embodiment of the invention shown in FIG. 7 taken along line 8—8 thereof.

DESCRIPTION OF THE PREFERRED EMBODIMENT

With reference to the drawings, a new and improved jet ski brake apparatus embodying the principles and concepts of the present invention will be described.

Turning to FIGS. 1–4, there is shown a first embodiment of the jet ski brake apparatus of the invention generally designated by reference numeral 10. In the first embodiment, jet ski brake apparatus 10 is for a water craft 11 that has a rear discharge nozzle 12 and includes a first craft attachment member 14 attached to a portion of the water craft 11. A hinge assembly 16 is connected to the first craft attachment member 14. A brake plate assembly 18 is connected to the hinge assembly 16. A brake plate control assembly is connected to the brake plate assembly 18. The brake plate control assembly includes a control cable 23 connected to the brake plate assembly 18. The water craft 11 is a jet ski.

In the embodiment of the invention shown in FIGS. 1–4, the first craft attachment member 14 is attached to the discharge nozzle 12 of the jet ski 11. The brake plate assembly 18 includes a control arm 22 which is connected to the hinge assembly 16. A control cable connection bracket 19 is connected to the control arm 22, and plate support struts 24 are connected to the control arm 22. A brake plate member 26 is connected to the plate support struts 24. The brake plate member 26 is oriented at a fixed acute orientation angle 30 with respect to the control arm 22.

The embodiment of the invention shown in FIGS. 1–4 operates as follows. As shown in the broken lines in FIG. 2, when the control cable 23 is tensed, the control cable 23 pulls on the control cable connection bracket 19, causing the brake plate assembly 18 to rotate around the hinge assembly 16 and have the brake plate member 26 elevated to a non-use position. The brake plate member 26 does not interfere with water flow exiting from the discharge nozzle 12 as represented by water flow lines 40.

However, when the brake plate assembly 18 is to be used for braking the forward motion of the jet ski 11, the control cable 23 is controlled by a hand-operated control on the handle bar of the jet ski 11, and tension on the control cable 23 is relaxed. When this occurs, the brake plate assembly 18 rotates around the hinge assembly 16 so that the brake plate member 26 is impinged upon by water flow lines 40. When this occurs, the brake plate member 26 deflects the water flow upward, as represented by upwardly flowing water flow lines 42. Such an upward deflection of water causes a downward reactive force on the brake plate member 26, and the downward force on the brake plate member 26 is transmitted to the stern of the jet ski 11 causing the stern of the jet ski 11 to be forced downward into the water, such that both stern of the jet ski 11 exerts a braking effect on the forward motion of the jet ski 11 through a body of water. It will be noted that the leading distal edge of the brake plate member (i.e. bottom-most edge as viewed in FIG. 2) extends slightly below the bottom of the hull of jet ski 11 when the brake plate assembly is in the "active braking" or use mode.

Turning to the embodiment of the invention shown in FIGS. 5 and 6, the first craft attachment member 14 is attached to a stern portion of the jet ski. A second craft attachment member 15 attached to a stern portion of the jet ski parallel to the first craft attachment member 14. The first craft attachment member 14 and the second craft attachment member 15 are connected to the stem portion of the jet ski 11 at positions above the discharge nozzle 12. A reinforcement strut 36 is connected between the first craft attachment member 14 and the second craft attachment member 15. The hinge assembly 16 extends between the first craft attachment member 14 and the second craft attachment member 15. The brake plate assembly 18 is connected directly to the hinge assembly 16. The brake plate assembly 18 includes a brake plate member 26 connected to the hinge assembly 16 and includes a control cable connection bracket 21 attached to an end portion of the brake plate member 26. The brake plate assembly 18 is positioned distal to the discharge nozzle 12 of the jet ski 11.

The operation of the embodiment of the invention shown in FIGS. 5 and 6 is very similar to the embodiment shown in FIGS. 1–4, with a number of differences, however. With the embodiment of the invention shown in FIGS. 5 and 6, the brake plate assembly 18 is in a non-use position, shown by broken lines in FIG. 5, when tension on the control cable 23 is relaxed. However, when the braking action of the brake plate member 26 is to be utilized. A tension is applied to the control cable 23. When this occurs, the tension from the control cable 23 is applied to the control cable connection bracket 21 thereby causing the brake plate member 26 to rotate counterclockwise in FIG. 5, causing the brake plate member 26 to be impinged by water flowing out from the discharge nozzle 12 of the jet ski 11 and by water flowing underneath the hull of the jet ski. As a result, water flow is directed upward, and a downward reactive force is transmitted to the stern of the jet ski 11 causing the stern of the jet ski 11 to be pushed downward into the water, such that braking action on forward motion of the jet ski 11 occurs.

In the embodiment of the invention shown in FIGS. 7 and 8, the craft attachment member 14 is connected to a stern portion of the jet ski 11 at a position below the discharge nozzle 12. The brake plate assembly 18 is positioned under the discharge nozzle 12 of the jet ski 11. A rudder member 32 is connected to a bottom portion of the discharge nozzle 12 and extends downward towards the brake plate assembly 18.

With the embodiment of the invention shown in FIGS. 7 and 8, water flows between the bottom of the discharge nozzle 12 and the top surface of the brake plate member 26. The top surface of the brake plate member 26 directs some of the water flow to the rudder member 32 which projects downward from the discharge nozzle 12. As a result, when the discharge nozzle 12 is moved to the right or left for steering the jet ski 11, the rudder member 32 is also moved to the right or left at the same time. The rudder member 32 interacts with the flow of water assisting the steering action to the right and to the left.

The components of the jet ski brake apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved brake apparatus for a water craft that is low in cost, relatively simple in design and operation, and which may advantageously be used to increase drag by forcing the stern of the water craft deeper into the water. With the invention, a brake apparatus for a water craft is provided which is under the control of the operator of the water craft. With the invention, a brake apparatus for a water craft is provided which easily fits onto a water craft having a conventional hull for easy retrofitting of the water craft with the brake apparatus. With the invention, a brake apparatus for a water craft is provided which is especially adapted for braking jet skis. With the invention, a jet ski brake apparatus is provided which assists in the steering of the jet ski as the jet ski is being braked.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Finally, it will be appreciated that the purpose of the annexed Abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A brake apparatus for a water craft that has a rear discharge nozzle, comprising:

a first craft attachment member attached to a portion of the water craft, a hinge assembly connected to said first craft attachment member, a brake plate assembly connected to said hinge assembly, and a brake plate control assembly connected to said brake plate assembly, wherein the water craft is a jet ski, wherein said first craft attachment member is attached to the discharge nozzle of the jet ski.

2. The apparatus of claim 1 wherein said brake plate control assembly includes a control cable connected to said brake plate assembly.

3. The apparatus of claim 1 wherein brake plate assembly includes:

a control arm connected to said hinge assembly, a control cable connection bracket connected to said control arm, plate support struts connected to said control arm, and a brake plate member connected to said plate support struts.

4. The apparatus of claim 3 wherein said brake plate member is oriented at a fixed acute orientation angle with respect to said control arm.

5. The apparatus of claim 1 wherein said brake plate assembly is connected directly to said hinge assembly.

6. The apparatus of claim 1 wherein said brake plate assembly includes a brake plate member connected to said hinge assembly and includes a control cable connection bracket attached to an end portion of said brake plate member.

7. The apparatus of claim 1 wherein said brake plate assembly is positioned distal to the discharge nozzle of the jet ski.

8. The apparatus of claim 1 wherein said craft attachment member is connected to a stern portion of the jet ski at a position below the discharge nozzle.

9. The apparatus of claim 1 wherein said brake plate assembly is positioned under the discharge nozzle of the jet ski.

10. The apparatus of claim 9, further including:

a rudder member connected to a bottom portion of the discharge nozzle and extending downward towards said brake plate assembly.

11. A brake apparatus for a water craft that has a rear discharge nozzle, comprising:

a first craft attachment member attached to a portion of the water craft, a hinge assembly connected to said first craft attachment member, a brake plate assembly connected to said hinge assembly, and a brake plate control assembly connected to said brake plate assembly, wherein the water craft is a jet ski, said apparatus further including:

a second craft attachment member attached to a stern portion of the jet ski parallel to said first craft attachment member.

12. The apparatus of claim 11 wherein said first craft attachment member and said second craft attachment member are connected to the stern portion of the jet ski at a position above the discharge nozzle.

13. The apparatus of claim 12, further including:

a reinforcement strut connected between said first craft attachment member and said second craft attachment member.

14. The apparatus of claim 11 wherein said hinge assembly extends between said first craft attachment member and said second craft attachment member.

* * * * *